US006928256B2

(12) United States Patent
Matsuda et al.

(10) Patent No.: US 6,928,256 B2
(45) Date of Patent: Aug. 9, 2005

(54) ELECTROPHOTOGRAPHIC ENDLESS BELT, PROCESS CARTRIDGE, AND ELECTROPHOTOGRAPHIC APPARATUS

(75) Inventors: Hidekazu Matsuda, Shizuoka (JP); Akihiko Nakazawa, Shizuoka (JP); Atsushi Tanaka, Shizuoka (JP); Tsunenori Ashibe, Shizuoka (JP); Takashi Kusaba, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 10/667,436

(22) Filed: Sep. 23, 2003

(65) Prior Publication Data

US 2004/0062567 A1 Apr. 1, 2004

(30) Foreign Application Priority Data

Sep. 30, 2002 (JP) ..... 2002-286416

(51) Int. Cl.[7] ..... G03G 15/00; G03G 15/16

(52) U.S. Cl. ..... 399/308; 399/121; 399/162; 399/165

(58) Field of Search ..... 399/159, 162, 399/165, 302, 303, 308, 313, 121, 111; 156/137; 198/804

(56) References Cited

U.S. PATENT DOCUMENTS

| | | | | |
|---|---|---|---|---|
| 5,713,067 | A | 1/1998 | Mizoe et al. | 399/176 |
| 6,615,015 | B2 | 9/2003 | Nakazawa et al. | 399/302 |
| 6,674,989 | B1 * | 1/2004 | Kusaba et al. | 399/302 |
| 2002/0085864 | A1 * | 7/2002 | Abe | 399/302 X |
| 2002/0159789 | A1 | 10/2002 | Kusaba et al. | 399/111 |
| 2003/0035661 | A1 * | 2/2003 | Kabata et al. | 399/162 |
| 2003/0063920 | A1 | 4/2003 | Kobayashi et al. | 399/113 |
| 2003/0099484 | A1 | 5/2003 | Tanaka et al | 399/113 |
| 2003/0118369 | A1 | 6/2003 | Nakazawa et al. | 399/111 |
| 2003/0202819 | A1 | 10/2003 | Matsuda et al. | 399/121 |
| 2003/0206749 | A1 | 11/2003 | Kashiwabara et al. | 399/121 |

FOREIGN PATENT DOCUMENTS

| | | | |
|---|---|---|---|
| JP | 58-214167 | | 12/1983 |
| JP | 59-230590 | | 12/1984 |
| JP | 62-50873 | | 3/1987 |
| JP | 7-187435 | | 7/1995 |
| JP | 7-45092 U | | 12/1995 |
| JP | 8-225178 | | 9/1996 |
| JP | 2000-131999 A | * | 5/2000 |
| JP | 2000-289823 A | * | 10/2000 |
| JP | 2001-206522 A | * | 7/2001 |
| JP | 2001-239534 A | * | 9/2001 |
| JP | 2003-131459 A | * | 5/2003 |

* cited by examiner

*Primary Examiner*—Sophia S. Chen
(74) *Attorney, Agent, or Firm*—Fitzpatrick, Cella, Harper & Scinto

(57) ABSTRACT

An electrophotographic endless belt has a beltlike substrate and a meandering-preventive member attached to the inner peripheral surface of the beltlike substrate via a pressure-sensitive adhesive, double-coated tape. The pressure-sensitive adhesive, double-coated tape is a pressure-sensitive adhesive, double-coated tape having i) a reinforcing base material and ii) pressure-sensitive adhesive layers on both sides of the reinforcing base material. The reinforcing base material has a thickness of from 25 μm or more to 200 μm or less, and the pressure-sensitive adhesive layers on both sides each have a thickness of 200 μm or less and at least one of the pressure-sensitive adhesive layers has a thickness of from more than 100 μm to 200 μm or less, and the meandering-preventive member has a hardness of from 15° or more to 70° or less. Also disclosed are a process cartridge and an electrophotographic apparatus which have the electrophotographic endless belt as an intermediate transfer belt.

10 Claims, 5 Drawing Sheets

ELECTROPHOTOGRAPHIC ENDLESS BELT, PROCESS CARTRIDGE, AND ELECTROPHOTOGRAPHIC APPARATUS

BACKGROUND OF TE INVENTION

1. Field of the Invention

This invention relates to an electrophotographic endless belt, and also relates to a process cartridge and an electrophotographic apparatus which have an electrophotographic endless belt.

2. Related Background Art

Besides rigid-body, drum-shaped members, flexible endless-belt-shaped members (electrophotographic endless belts) are conventionally used in intermediate transfer members, electrophotographic photosensitive members, transfer-transport members, fixing members and so forth used in electrophotographic apparatus, such as copying machines and laser beam printers.

Usually, in an electrophotographic apparatus, an electrophotographic endless belt is stretched over, and supported on, at least two rollers (stretch-over rollers) disposed on its inner-periphery side and is rotatingly driven under the application of any desired tension when used.

However, because of frequently possible slight errors or scattering in the diameter, deflection, rotating-shaft straightness and roller-to-roller parallelism of the stretch-over rollers stretchedly supporting the electrophotographic endless belt, it is difficult to prevent the electrophotographic endless belt from meandering from side to side during its rotating drive.

Such meandering of the electrophotographic endless belt from side to side makes the exposure position and the transfer position deviate to cause image misregistration. Also, in the case of a full-color electrophotographic apparatus, it makes the position of image formation deviate for each color to cause color misregistration when color toner images are superimposed on the electrophotographic endless belt or on a transfer material transported on the electrophotographic endless belt.

Accordingly, in order to prevent the electrophotographic endless belt from meandering like this, various methods have ever been proposed. In these recent years, a large number of methods have been proposed in which a meandering-preventive member is provided on the inner peripheral surface of a beltlike substrate to prevent the electrophotographic endless belt from meandering.

For example, a method is available in which stretch-over rollers, each provided over the whole outer peripheries thereof with a groove that may fit in the cross-sectional shape of such a meandering-preventive member, are used and an electrophotographic endless belt provided with the meandering-preventive member over the whole inner peripheral surface is rotated, making the meandering-preventive member fit in each groove of the stretch-over rollers to prevent the electrophotographic endless belt from meandering.

As another example, a method is available in which stretch-over rollers each having substantially the same length as the distance between inner sides of meandering-preventive members provided on both ends of a beltlike substrate of an electrophotographic endless belt are used and the electrophotographic endless belt is stretched over these stretch-over rollers and is rotated making its both-end meandering-preventive members and the stretch-over rollers fit in each other to prevent the belt from meandering.

As still another example, a method is available in which stretch-over rollers, each provided on one end in the axial direction thereof with a terraced portion in which a meandering-preventive member of an electrophotographic endless belt fits, are used to prevent the electrophotographic endless belt from meandering.

The above methods can make the electrophotographic endless belt travel smoothly without bringing it into a meandering state. This enables the formation of good images free of any image misregistration or color misregistration.

As methods by which the beltlike substrate is provided with the meandering-preventive member, the following methods are known in the art.

Japanese Patent Application Laid-Open No. S57-214167 discloses a method in which the meandering-preventive member is bonded with an adhesive to the inner peripheral surface of the beltlike substrate. This method has a disadvantage that the handling of the adhesive itself is troublesome and is automatable with difficulty. There is also a problem that the attachment position may gradually change because of the flowability of the adhesive, unless the meandering-preventive member and the beltlike substrate are kept firmly held by some means until the adhesive hardens completely. This makes it difficult to improve productivity because the meandering-preventive member must be fastened and supported so as not to shift. This method also has disadvantages that the adhesive may slip to lower the attachment precision of the meandering-preventive member. There is a further problem that it is difficult to control the adhesive not to protrude and this may adversely affect the travel performance of the electrophotographic endless belt.

In such a method, the electrophotographic endless belt has a superior durability, but has a poor attachment precision, and is producible so inefficiently as to result in a high cost. Moreover, this method tends to harm the operating environment. Thus, this method has been unsatisfactory.

A method is also available in which, as disclosed in Japanese Patent Application Laid-Open No. S59-230590, a hotmelt pressure-sensitive adhesive is used as a meandering-preventive member as it is, and also a method is available in which, as disclosed in Japanese Utility Model Publication No. H07-45092, a cold-curing silicone rubber is coated so as to be used as a meandering-preventive member as it is. In such methods, however, it is difficult to produce meandering-preventive members having a constant accuracy in shape and dimension, and the meandering-preventive member obtained has such a poor straightness as to put obstacles in the way of stable travel of the electrophotographic endless belt. It also lacks in productivity and automation adaptability, and involves a high cost. Thus, this method can not be said to be a preferable method.

To solve the above problems and the cost of as electrophotographic apparatus have become lower in recent years, a method is proposed in which, for the purpose of attaching the meandering-preventive member to the beltlike substrate at a low cost and with good precision, the meandering-preventive member is attached (stuck) to the beltlike substrate not by the method described above, but by the use of a pressure-sensitive adhesive, double-coated tape. The method making use of a pressure-sensitive adhesive, double-coated tape has the advantages that it is easy to handle because of its bond strength immediately after sticking, permitting it to be positioned with ease, and it is suited for automation. As a result, the meandering-preventive member can be stuck to the beltlike substrate with a good dimensional accuracy.

The method in which the meandering-preventive member is attached (stuck) to the beltlike substrate by the use of a pressure-sensitive adhesive, double-coated tape has a great advantage as described above. It, however, is not the case that the meandering-preventive member can be attached with a good precision whatever pressure-sensitive adhesive, double-coated tape is used.

For example, where as disclosed in Japanese Patent Application Laid-Open No. S62-50873, a pressure-sensitive adhesive, double-coated tape having no "reinforcing base material," and consisting of only a pressure-sensitive adhesive, is used when the meandering-preventive member is attached to the beltlike substrate, the pressure-sensitive adhesive, double-coated tape may expand and contract in accordance with the expansion and contraction of the meandering-preventive member, so that the meandering-preventive member may be stuck to the beltlike substrate in the state in which the former has partially expanded or contracted. Thus, it is difficult to attach the meandering-preventive member to the beltlike substrate with good precision.

The pressure-sensitive adhesive, double-coated tape consisting of only a pressure-sensitive adhesive also has a problem that it has so low a peel strength as to slip gradually with the lapse of time when used in an environment of high temperature. Thus, this tape has a disadvantage that it can not endure long term use.

As a method which can solve the above problems, Japanese Patent Application Laid-Open No. H07-187435, e.g., discloses an example in which a pressure-sensitive adhesive, double-coated tape having a reinforcing base material is used.

The use of a reinforcing base material enables improvement in attachment precision. However, its bond strength and its maintenance is inadequate.

As a pressure-sensitive adhesive layer of the pressure-sensitive adhesive, double-coated tape, Japanese Patent Applications Laid-Open No. H07-187435 and No. H08-225178, e.g., specify that the thickness of the pressure-sensitive adhesive layer is 5 μm or more to 100 μm or less. Usually, the beltlike substrate and the meandering-preventive member are required to have non-tackiness and slipperiness in view of their use in image formation and the required mechanical properties. As materials that satisfy these requirements, materials having scanty adhesion as exemplified by fluorine-atom-containing resins are used in many cases, and it is actually difficult to achieve both image characteristics and bond strength if the thickness of the pressure-sensitive adhesive layer is in the range disclosed in the above publications. Thus, as an electrophotographic endless belt, its performance has not been satisfactory.

As discussed above, in regard to the attachment of the meandering-preventive member to the beltlike substrate, any method that can satisfy all of durability, attachment precision and bond strength has not been made available.

Flexibility of the meandering-preventive member is also an important characteristic when it is used as an attachment to the beltlike substrate.

Where the meandering-preventive member has a sufficiently high flexibility, it has a higher follow-up performance to the beltlike substrate, and hence the electrophotographic endless belt can smoothly rotate and travel. On the other hand, there is a problem that, when the electrophotographic endless belt has meandered to apply a twist force to the meandering-preventive member, the meandering-preventive member has no resilience strong enough to respond to its stress sufficiently and hence its meandering-preventing function may be damaged. Any too soft meandering-preventive member also has problems that it makes the meandering-preventive member itself have a low working precision and that it lowers attachment precision to the beltlike substrate.

On the contrary, where the meandering-preventive member has a poor flexibility, the effect of preventing the belt from meandering is sufficiently obtainable, but there is a problem that, because of a difference in stiffness (nerve or rigidity) of the meandering-preventive member from that of the beltlike substrate, the belt is hindered from traveling smoothly, and can not travel in a stable manner.

As a method which can solve the above problems, a method is available in which the electrophotographic endless belt is stretched over the rollers at a higher tension (belt tension). There, however, is a possibility that a higher belt tension causes creep of the electrophotographic endless belt to shorten its lifetime. There is also a possibility that too high a belt tension makes the electrophotographic endless belt meander more.

In particular, an electrophotographic endless belt set in a process cartridge may often undergo much vibration or be placed in an environment of high temperature and high humidity at the stage of distribution in the market, which environment is different from the environment in which it is used in the main body of an electrophotographic apparatus. In the case when it has been placed in such a severe environment for a long time, the pressure-sensitive adhesive may slip more, so that, when the process cartridge is set and used in the main body of an electrophotographic apparatus, the attachment precision of the meandering-preventive member may have already been out of order, so that the meandering-preventive member may often no longer function as such. For this reason, the above problem has more remarkably arisen in electrophotographic endless belts set in process cartridges.

SUMMARY OF THE INVENTION

An object of the present invention is to provide an electrophotographic endless belt that may not cause the above problems, enables smooth belt travel, and is almost free from meandering over a long period of time.

Another object of the present invention is to provide a process cartridge and an electrophotographic apparatus which have the above electrophotographic endless belt as an intermediate transfer belt.

The present invention provides an electrophotographic endless belt comprising a beltlike substrate and a meandering-preventive member attached to the inner peripheral surface of the beltlike substrate via a pressure-sensitive adhesive, double-coated tape; the pressure-sensitive adhesive, double-coated tape being a pressure-sensitive adhesive, double-coated tape having i) a reinforcing base material and ii) pressure-sensitive adhesive layers on both sides of the reinforcing base material, wherein:

the reinforcing base material has a thickness of from 25 μm or more to 200 μm or less;

the pressure-sensitive adhesive layers on both sides each have a thickness of 200 μm or less and at least one of the pressure-sensitive adhesive layers has a thickness of from more than 100 μm to 200 μm or less; and the meandering-preventive member has a hardness of from 15° or more to 70° or less.

The present invention also provides a process cartridge and an electrophotographic apparatus which have the above electrophotographic endless belt.

DESCRIPTION OF THE PREFERRED EMBODIMENTS

Figure 1:
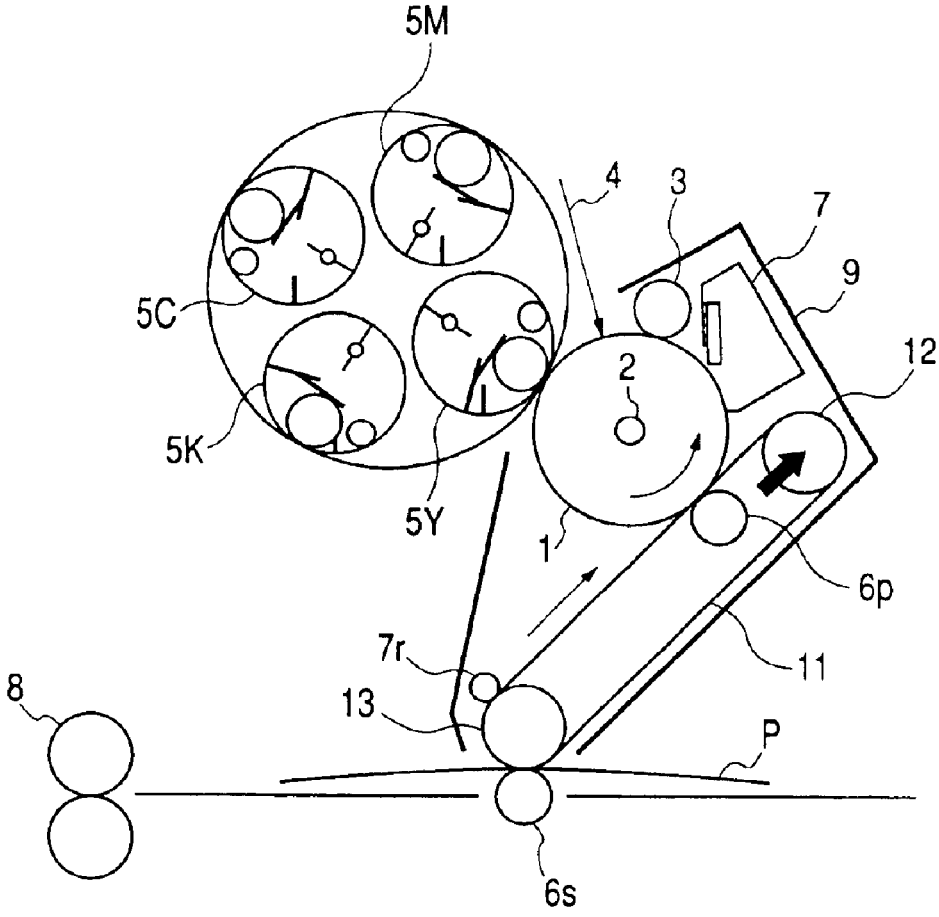
FIG. 1 is a schematic view showing an example of the construction of a full-color electrophotographic apparatus having an intermediate transfer belt/electrophotographic apparatus integral process cartridge.

The electrophotographic endless belt of the present invention is an electrophotographic endless belt comprising a beltlike substrate and a meandering-preventive member attached (stuck) to the inner peripheral surface of the beltlike substrate via a pressure-sensitive adhesive, double-coated tape. The pressure-sensitive adhesive, double-coated tape in the present invention refers to one with which the meandering-preventive member can be bonded at a normal temperature, in a short time and only under the application of a slight pressure. It is synonymous with "self-adhesive double-coated tape," "double-coated tape," "adhesive double-coated tape" and the like, and embraces these as well.

As a method for producing the meandering-preventive member, it may include the following method.

(1) A synthetic rubber as a material is formed into a sheet with a desired thickness, and the double-coated tape is stuck to one side of the sheet.
(2) Next, this sheet with double-coated tape is cut into an oblong card so as to be in agreement with the width of a desired cross-sectional shape.
(3) Next, the sheet thus cut is cut in a length that fits with the length of the inner periphery of the beltlike substrate.

Thus, a meandering-preventive member having a desired cross-sectional shape can be obtained.

In the present invention, the pressure-sensitive adhesive, double-coated tape used when the meandering-preventive member is stuck to the beltlike substrate has a reinforcing base material, and has pressure-sensitive adhesive layers on both sides of the reinforcing base material. The use of the pressure-sensitive adhesive, double-coated tape having a reinforcing base material brings the effect of improving working precision and attachment precision (sticking precision) of the meandering-preventive member and improving bond strength, and also enables prevention of the meandering-preventive member from slipping. If no reinforcing base material is present, low working precision, low dimensional accuracy, and low attachment precision (sticking precision) may result. Also, the bond strength of the meandering-preventive member to the beltlike substrate may become insufficient, and the former would tend to slip.

The pressure-sensitive adhesive layers of the pressure-sensitive adhesive, double-coated tape are each (on each side) 200 μm or less in thickness. If the pressure-sensitive adhesive layers each have a thickness of more than 200 μm, the meandering-preventive member tends to slip because of stress applied to the meandering-preventive member, under the influence of the viscosity of the pressure-sensitive adhesive, so that image misregistration or color misregistration may more occur. Further, at least one of the pressure-sensitive adhesive layers of the pressure-sensitive adhesive, double-coated tape has a thickness of from more than 100 μm to 200 μm or less. If the pressure-sensitive adhesive layers have a thickness of 100 μm or less on each side, the meandering-preventive member may lack in bond strength. Here, the thickness of at least one of the pressure-sensitive adhesive layers of the pressure-sensitive adhesive, double-coated tape may more preferably be in the range of from 110 μm or more to 190 μm or less.

The meandering-preventive member also has a hardness of from 15° or more to 70° or less. If it has a hardness of less than 15°, it may be too soft to sufficiently function to prevent the belt from meandering as so intended primarily, also resulting in a low working precision and a low sticking precision. If, on the other hand, it has a hardness of more than 70°, it may be too hard to have flexibility, bringing about no stable belt-travel performance. The hardness of the meandering-preventive member may more preferably be in the range of from 20° or more to 60° or less, and still more preferably in the range of from 25° or more to 50° or less.

The beltlike substrate of the electrophotographic endless belt of the present invention may include one composed chiefly of a thermoplastic resin, a thermosetting resin or a rubber. The one composed chiefly of a thermoplastic resin is preferred.

As the thermoplastic resin, it may include, e.g., olefin resins such as polyethylene and polypropylene, polystyrene resins, acrylic resins, ABS resins, polyester resins (such as PET, PBT, PEN and PAR), polycarbonate resins, sulfur-containing resins such as polysulfone, polyether sulfone and polyphenylene sulfide, fluorine-containing resins such as polyvinylidene fluoride and a polyethylene-tetrafluoroethylene copolymer, polyurethane resins, silicone resins, ketone resins, polyvinylidene chloride, thermoplastic polyimide resins, polyamide resins, modified polyphenylene oxide resins, and various modified resins or copolymers of these. Any one or more kinds of these may be used. Of these resins, fluorine-containing resins are preferred from the viewpoint of non-tackiness or slipperiness of the beltlike substrate.

When the electrophotographic endless belt is used in the electrophotographic apparatus, it is also necessary to regulate its electrical resistance value to adapt it to the electrophotographic process in which it is used.

There are no particular limitations on additives incorporated in the beltlike substrate in order to regulate the electrical resistance value of the beltlike substrate of the electrophotographic endless belt of the present invention. As a conductive filler for regulating the resistance, it may include carbon black and various conductive metal oxides. As a non-filler type resistance regulator, it may include low-molecular weight ion conducting materials, such as various metal salts and glycols, antistatic resins containing an ether linkage or a hydroxyl group in the molecule, and organic high polymers showing electroconductivity.

There are also no particular limitations on processes for producing the beltlike substrate of the electrophotographic endless belt of the present invention. Any process commonly used for producing endless belts may be employed, and a production process having so high a production efficiency as to enable cost saving is preferred. As a method therefor, a method is available in which an extrusion material is continuously melt-extruded from a circular die and thereafter the product thus extruded is cut in any necessary length to produce an endless belt. For example, blown-film extrusion (inflation) is preferable.

An example of a method of producing the beltlike substrate of the electrophotographic endless belt used in the present invention is described below.

Figure 2:
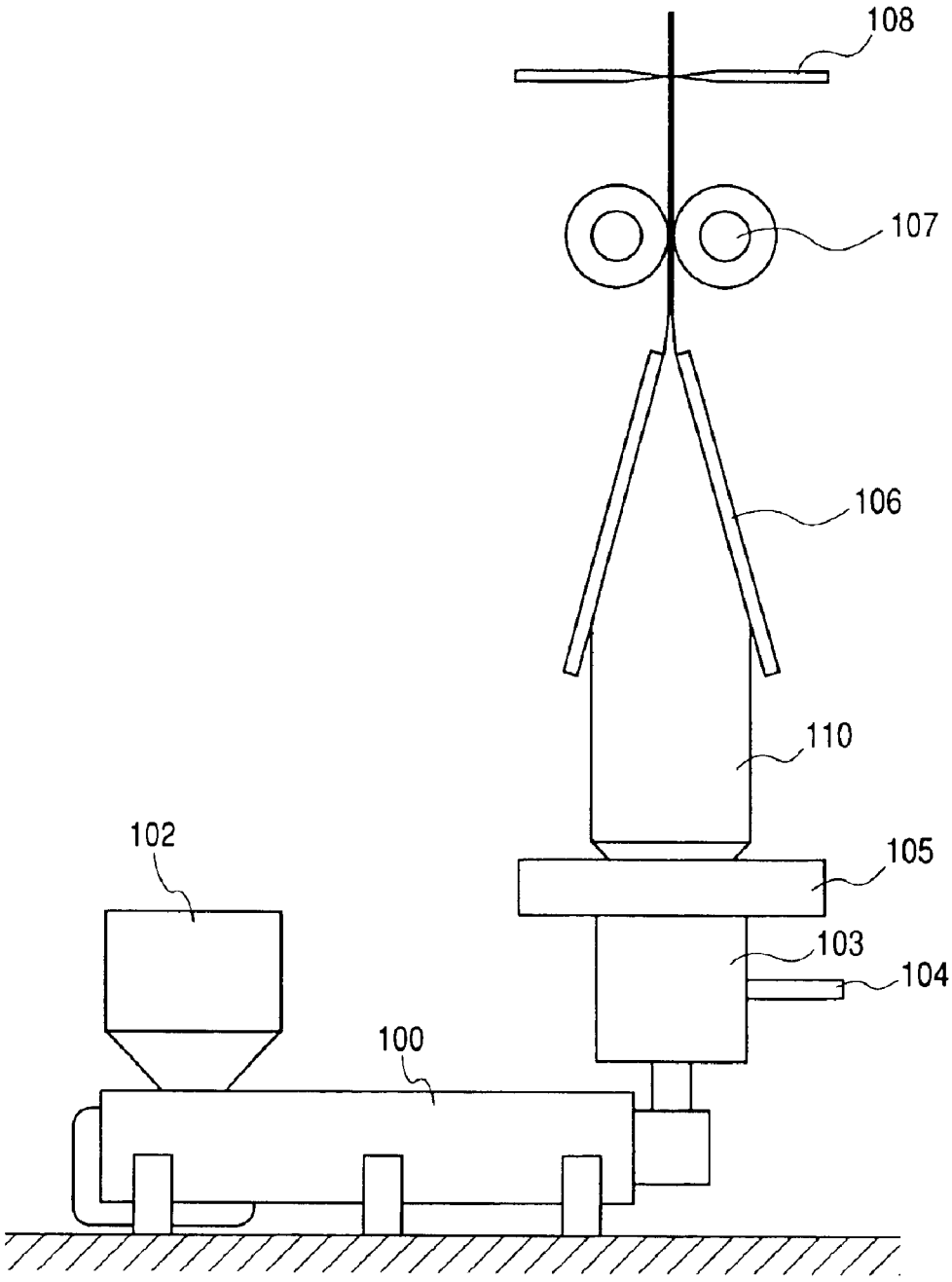
FIG. 2 is a schematic view showing an example of the construction of an extrusion apparatus (blown-film extrusion apparatus) for forming an electrophotographic endless belt (single layer).

FIG. 2 schematically shows an example of the construction of an extrusion apparatus (blown-film extrusion apparatus) for forming the beltlike substrate of the electrophotographic endless belt of the present invention. This extrusion apparatus consists chiefly of an extruder, an extruder die and a gas blowing unit.

First, materials such as an extrusion raw material (resin or rubber), a conducting agent and other additives are premixed under the desired formulation and thereafter are kneaded and dispersed to prepare an extrusion material, which is then put into a hopper 102 installed to an extruder 100.

The extruder 100 has a preset temperature and extruder screw construction which have been so selected that the extrusion material may have a melt viscosity necessary for enabling extrusion into a belt in the post step and that the materials can be dispersed uniformly with respect to one another.

The extrusion material is melt-kneaded in the extruder 100 into a melt, which then enters a circular die 103. The circular die 103 is provided with a gas inlet passage 104. Through the gas inlet passage 104, gas (air) is blown into the center of the circular die 103, whereupon the melt having passed through the circular die 103 inflates while scaling up in the diametrical direction to come into a tubular film 110.

The gas to be blown here may be air, and besides may be selected from nitrogen, carbon dioxide and argon.

The extruded product having thus inflated (tubular film) is drawn upward while being cooled by an outside-cooling ring 105. Usually, in such a blown-film extrusion apparatus, a method is employed in which the tubular film 110 is pressed forcibly from the right and the left by means of stabilizing plates 106 to fold it into a sheet, and then drawn off at a constant speed while being so sandwiched with pinch rollers 107 that the air in the interior does not escape.

Then, the tubular film thus drawn off is cut with a cutter 108 to obtain a tubular film with the desired size.

Next, this tubular film is worked using a form (for shaping) in order to regulate its surface smoothness and size and to remove any folds made in the film at the time of draw off. Stated specifically, a method is usable which makes use of a set of cylindrical forms made of materials having different coefficients of thermal expansion and having different diameters.

A small-diameter cylindrical form (inner form) has a coefficient of thermal expansion made larger than the coefficient of thermal expansion of a large-diameter cylindrical form (outer form). The tubular film obtained by extrusion is placed over this inner form. Thereafter, the inner form with film is inserted into the outer form so that the tubular film is held between the inner form and the outer form. A gap between the inner form and the outer form may be determined by calculation on the bases of the heating temperature, the difference in the coefficients of thermal expansion between the inner form and the outer form and the pressure required.

A form in which the inner form, the tubular film, and the outer form have been set in the order from the inside is heated to the vicinity of the softening point temperature of the extrusion material used in the tubular film. As a result of the heating, the inner form, having a larger coefficient of thermal expansion, acts so as to expand more than the inner diameter of the outer form and hence a uniform pressure is applied to the whole tubular film. Here, the surface of the tubular film having reached the vicinity of its softening point is pressed against the inner surface of the outer form having been worked smoothly, so that the smoothness of the surface of the tubular film is improved. Thereafter, these are cooled and the tubular film is removed from the forms, thus attaining smooth surface characteristics.

It is more preferable to use the above method as a method of producing a beltlike substrate having a small right-and-left difference in inner peripheral length in order to prevent the belt from meandering.

Figure 3:
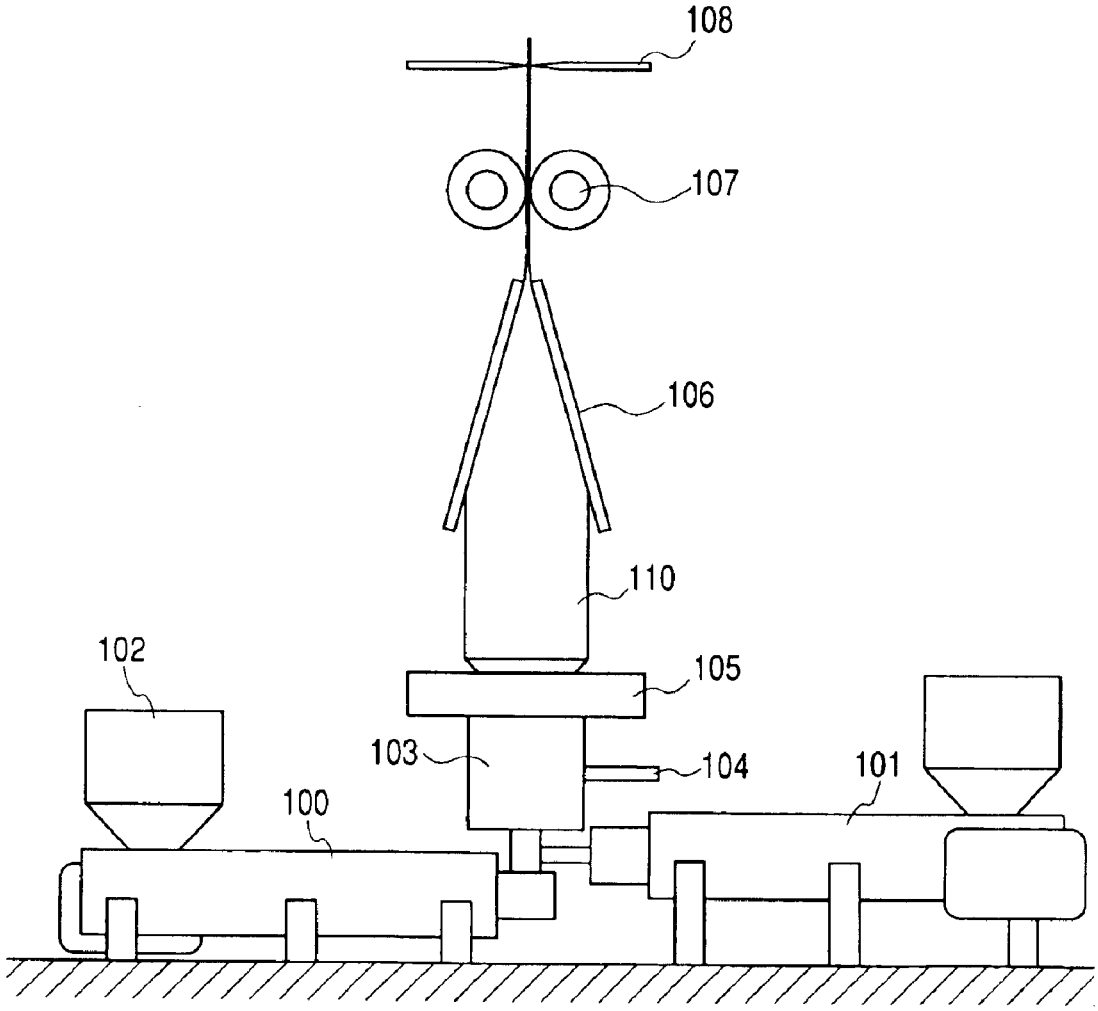
FIG. 3 is a schematic view showing an example of the construction of an extrusion apparatus (blown-film extrusion apparatus) for forming an electrophotographic endless belt (double layer).

The foregoing description relates to a single-layer belt. In the case of the endless belt of double-layer construction, an extruder 101 is additionally provided as shown in FIG. 3. Simultaneously with the kneaded melt held in the extruder 100, a kneaded melt in the extruder 101 is sent to a double-layer circular die 103, and the two layers are scale-up inflated simultaneously, thus obtaining a double-layer belt. In the case of a triple- or more layer construction, the extruders may of course be provided in the number corresponding to the number of layers. Thus, the present invention makes it possible to extrude not only electrophotographic endless belts (beltlike substrates) of a single-layer construction, but also those of multi-layer construction with a good dimensional accuracy through one step and also in a short time. The fact that the extrusion can be made in a short time means that mass production and low-cost production can be achieved.

With regard to the thickness ratio of the extruded tubular film to the width of a gap (die slit) of the circular die, the ratio of the former to the latter may preferably be not more than ⅓, and particularly preferably not more than ⅕.

With regard to the ratio of the outer diameter of the tubular film to the outer diameter of the gap (die slit) of the circular die, it may preferably be in the range of from 50% to 400%.

These values represent the state of stretch of the material. If the thickness ratio is more than ⅓, the film may insufficiently stretch to tend to cause difficulties such as low strength, uneven resistance, and uneven thickness. As for the ratio of the outer diameter of the tubular film to the outer diameter of the gap (die slit) of the circular die, if it is more than 400% or less than 50%, the film has stretched in excess, resulting in a low extrusion stability or making it difficult to secure the thickness necessary for the present invention.

The beltlike substrate of the electrophotographic endless belt of the present invention may preferably have a thickness of from 40 $\mu$m or more to 500 $\mu$m or less, and more preferably from 50 $\mu$m or more to 300 $\mu$m or less. If it has a thickness of less than 40 $\mu$m, the belt may have insufficient strength, or the belt tends to lengthen. If, on the other hand, it has a thickness of more than 500 $\mu$m, the belt may flexibly deform with difficulty. Hence, a problem may arise that the apparatus must be made to have a large size because any driving at uniform speed using small-diameter rollers can not be performed.

The meandering-preventive member of the electrophotographic endless belt according to the present invention may preferably have a thickness of from 0.3 mm to 6 mm. If it has a thickness of less than 0.3 mm, any sufficient meandering-preventive effect may not be obtained and, in some cases, the meandering-preventive member may even run on the roller. If, on the other hand, it has a thickness of more than 6 mm, the difference between the inner peripheral length of the beltlike substrate of the electrophotographic endless belt and the inner peripheral length of the meandering-preventive member may become so large that, in actual use of the electrophotographic endless belt, the meandering-preventive member may not follow up any bend of the electrophotographic endless belt when the electrophotographic endless belt travels over the part where it winds around the stretch-over rollers over which it is stretched, resulting in poor flexing properties of the endless belt.

The meandering-preventive member may also preferably have a width of from 1 mm or more to 10 mm or less. It has a width of less than 1 mm, a sufficient meandering-preventive effect can be obtained with difficulty. If, on the other hand, it has a width of more than 10 mm, it may make small the area of the part that functions as a belt, and moreover may make large-size the electrophotographic apparatus in which such a belt is set and used.

As to materials and characteristics of the reinforcing base material of the pressure-sensitive adhesive, double-coated tape, there are no particular limitations thereon as long as it can maintain the attachment precision (sticking precision). It may include, e.g., sheets of paper such as kraft paper, Japanese paper and crepe paper; single or mixed woven fabrics of rayon (staple fiber), cotton, acetate, glass, polyester, Vinylon and the like; waste fabrics of polyethylene, polypropylene and the like; non-woven fabrics of rayon, polypropylene, aromatic polyamide, polyester, glass and the like; cellophane; films of acetate, polyvinyl chloride, polyethylene, polypropylene and the like; single or mixed rubber sheets of polyurethane rubber, natural rubber, styrene-butadiene rubber, polychloroprene rubber and the like; and foams of polyurethane, polyethylene, butyl rubber, polychloroprene rubber, acrylic rubber and the like.

Of these, materials which may particularly preferably be used include non-woven fabrics of rayon, polypropylene, aromatic polyamide, polyester, glass and the like. These have good workability, promise superior working precision and attachment precision (sticking precision), are available at a low price, and have the effect of improving bond strength greatly.

In the present invention, the reinforcing base material of the pressure-sensitive adhesive, double-coated tape has a thickness of from 25 $\mu$m or more to 500 $\mu$m or less. If the reinforcing base material has a thickness of less than 25 $\mu$m, it may have a small reinforcing effect to make the meandering-preventive member have low working precision, attachment precision (sticking precision) and bond strength, so that the meandering-preventive member tends to slip. If, on the other hand, it has a thickness of more than 200 $\mu$m, it is too thick, and hence may have too high a rigidity to be flexible, so that the meandering-preventive member can not follow up any bend of the electrophotographic endless belt when the electrophotographic endless belt is rotatingly driven, and the belt may wrinkle or the meandering-preventive member may come off.

The reinforcing base material may also preferably have a modulus in tension of 98 N/mm$^2$ or more. If it has a modulus in tension of less than 98 N/mm$^2$, a sufficient reinforcing effect may be obtained with difficulty.

The pressure-sensitive adhesive of the pressure-sensitive adhesive, double-coated tape, may include rubber-type adhesives such as urethane rubber types, natural rubber types, styrene-butadiene rubber types, isobutylene rubber types, isoprene rubber types, a styrene-isoprene block copolymer and a styrene-butadiene block copolymer; acrylic type adhesives; and silicone type adhesives. Also, any of these materials, or any of these and other materials, may be used in combination of two or more. Of these, a pressure-sensitive adhesive, double-coated tape making use of an acrylic pressure-sensitive adhesive is preferred as having superior bond strength.

As a material of the meandering-preventive member, any material may be used as long as it has the hardness within the range of the present invention. For example, it may include solids or foams of isoprene rubber, styrene-butadiene rubber, butadiene rubber, ethylene-propylene rubber, chloroprene rubber, nitrile rubber, polyurethane rubber, epichlorohydrin rubber, silicone rubber, fluorine rubber and the like. In particular, polyurethane rubber and silicone rubber are preferred as having a compression set superior to that of other materials. Foams of these materials are also preferred as having superior flexibility, having less influence on the flexing properties of the electrophotographic endless belt, and achieving stable belt travel performance.

The electrophotographic endless belt of the present invention may also preferably be used as an intermediate transfer belt. In particular, it is very preferably usable as an intermediate transfer belt for a process cartridge which integrally supports an intermediate transfer belt and an electrophotographic photosensitive member and is detachably mountable to the main body of an electrophotographic apparatus (an intermediate transfer belt/electrophotographic photosensitive member integral process cartridge).

Even where the intermediate transfer belt/electrophotographic photosensitive member integral process cartridge is placed in a severe environment of a high temperature and a high humidity environment during distribution in the market in the state it is kept stretched over the rollers for a long term, any slip or the like does not occur between the meandering-preventive member and the endless belt as long as the intermediate transfer belt, which is the electrophotographic endless belt of the present invention, is used. The intermediate transfer belt maintains a quality equal to that at the time of manufacture and shipment, and can function as an intermediate transfer belt almost free from meandering.

The process cartridge is also commonly handled as an article for consumption. Hence, it is desired that the process cartridge can more inexpensively be manufactured. Accordingly, the component parts constituting it are also desired to be inexpensive. As in the present invention, the pressure-sensitive adhesive, double-coated tape commercially available at a low price may be used to attach the meandering-preventive member to the beltlike substrate. This enables the achievement of a cost reduction.

For the purpose of making the process cartridge compact and achieving a cost reduction, it is also preferable to use as a cleaning system for the intermediate transfer belt a cleaning-at-primary transfer method in which secondary-transfer residual toner is charged to a polarity reverse to that at the time of primary transfer and returned from the surface of the intermediate transfer belt to the latent-image-bearing member simultaneously with the primary transfer.

Stated specifically, it is a system in which electric charges with a polarity reverse to that at the time of primary transfer are imparted to the secondary-transfer residual toner remaining on the intermediate transfer belt, by applying a voltage to a charge-providing means (e.g., a medium-resistance elastic roller) disposed separably on the intermediate transfer belt, and the secondary-transfer residual toner are returned to the electrophotographic photosensitive member by the aid of a primary-transfer electric field at the subsequent primary transfer zone. Of course, as the charge-providing means, a corona charging assembly or a bladelike charging assembly may be used besides the roller. Any means having any shape may be used as long as the electric charges can be imparted to the secondary-transfer residual toner remaining on the intermediate transfer belt.

The secondary-transfer residual toner returned from the surface of the intermediate transfer belt to the electrophotographic photosensitive member is removed by a cleaning means for the electrophotographic photosensitive member, such as a cleaning blade. This system is greatly effective in making the process cartridge compact and low-cost. It is also possible to discard the primary-transfer residual toner and the secondary-transfer residual toner simultaneously, and hence a high maintenance performance can also be secured.

The intermediate transfer belt may also preferably be of a system in which it is stretched over two stretch-over rollers, in view of the advantage that the drive mechanism is simple, and is suited for reducing the number of component parts and for making the cartridge compact, enabling manufacture at a lower cost.

Of the stretch-over rollers over which the intermediate transfer belt is stretched, a tension roller, which applies a tension to the intermediate transfer belt, may preferably be slidable with respect to the direction in which the intermediate transfer belt elongates, in order to react to any elongation of the intermediate transfer belt. It may preferably be slidable by 1 mm or more to 5 mm or less. Also, in order for the intermediate transfer belt to be surely driven without slipping, the intermediate transfer belt may preferably be stretched over the rollers at a force of from 5 N or more to 70 N or less.

An electrophotographic apparatus is specifically described below which has an intermediate transfer belt/electrophotographic photosensitive member integral process cartridge making use of the electrophotographic endless belt as an intermediate transfer belt.

FIG. 1 is a schematic view showing an example of the construction of a full-color electrophotographic apparatus having an intermediate transfer belt/electrophotographic photosensitive member integral process cartridge.

In the apparatus shown in FIG. 1, reference numeral 1 denotes a drum-shaped electrophotographic photosensitive member, which is rotatingly driven around an axis 2 in the direction of an arrow inside member 1 in FIG. 1 at a prescribed peripheral speed.

The electrophotographic photosensitive member 1 is uniformly electrostatically charged on its peripheral surface to a positive or negative potential through a charging means (primary charging means) 3. The photosensitive member thus charged is then exposed to exposure light 4 (imagewise exposure light) emitted from an exposure means (not shown) for slit exposure or laser beam scanning exposure. The exposure light used here is exposure light corresponding to a first-color-component image (e.g., a yellow-component image) of the intended full-color image. Thus, on the peripheral surface of the electrophotographic photosensitive member 1, a first-color-component electrostatic latent image (a yellow-color-component electrostatic latent image) is successively formed, which corresponds to the first-color-component image of the intended full-color image. Voltage applied to the charging means 3 may be only a direct-current voltage or a direct-current voltage on which an alternating-current has been superimposed.

An intermediate transfer belt 11 stretched over a stretch-over roller 12 and a secondary-transfer opposing roller (stretch-over roller) 13 is rotatingly driven in the direction of an arrow at substantially the same peripheral speed as the electrophotographic photosensitive member 1 (e.g., at a speed of 97 to 103% with respect to the peripheral speed of the electrophotographic photosensitive member 1). The stretch-over roller 12 is also a tension roller for applying tension to the intermediate transfer belt, and the secondary-transfer opposing roller 13 is also a drive roller for driving the intermediate transfer belt rotatingly.

The electrophotographic photosensitive member 1 and the secondary-transfer opposing roller 13 have a coupling (not shown) between them so that the rotational driving force is transmitted from the main body of the electrophotographic apparatus.

The first-color-component electrostatic latent image formed on the peripheral surface of the electrophotographic photosensitive member 1 is developed with a first-color toner (yellow toner) by a first-color-component developing means (yellow-component developing means) 5Y to form a first-color toner image (yellow toner image). At this stage, a second-color-component developing means (magenta-component developing means) 5M, a third-color-component developing means (cyan-component developing means) 5C and a fourth-color-component developing means (black-component developing means) 5K each stand unoperated and do not act on the electrophotographic photosensitive member 1.

Then, the first-color toner image formed and held on the peripheral surface of the electrophotographic photosensitive member 1 is successively primarily transferred to the peripheral surface of the intermediate transfer belt 11 passing through between the electrophotographic photosensitive member 1 and a primary-transfer means (primary-transfer roller) 6*p*, by the aid of a primary-transfer bias applied from the primary-transfer means 6*p*.

The peripheral surface of the electrophotographic photosensitive member 1 from which the first-color toner image has been transferred is cleaned by a cleaning means 7 to remove primary transfer residual toner to make the surface clean. Thereafter, the photosensitive member thus cleaned is used for next-color image formation.

A second-color toner image (magenta toner image), a third-color toner image (cyan toner image) and a fourth-color toner image (black toner image) are likewise transferred to the peripheral surface of the electrophotographic photosensitive member 1, and then sequentially primarily transferred to the peripheral surface of the intermediate transfer belt 11. Thus, a synthesized toner image corresponding to the intended full-color image is formed on the peripheral surface of the intermediate transfer belt 11. In the course of the first-color to fourth-color primary transfer, a secondary-transfer means (secondary-transfer roller) 6*s* and a charge-providing means (charge-providing roller) 7*r* stand separate from the peripheral surface of the intermediate transfer belt 11.

The synthesized toner image having been primarily transferred onto the intermediate transfer belt 11 is successively transferred to a transfer material (such as paper) P by the aid of a secondary-transfer bias applied from the secondary-transfer means 6*s*; the transfer material P being taken out and fed from a transfer material feeding means (not shown) to the part (contact zone) between the intermediate transfer belt 11 and the secondary-transfer means 6*s* in a manner synchronized with the rotation of the intermediate transfer belt 11.

The transfer material P to which the synthesized toner image has been transferred is separated from the peripheral surface of the intermediate transfer belt 11 and guided into a fixing means 8, where the synthesized toner image is fixed, and is then put outside the apparatus as a color image-formed matter (a print or copy).

The charge-providing means 7*r* is brought into contact with the peripheral surface of the intermediate transfer belt 11 to which the synthesized toner image has been transferred. The charge-providing means 7*r* provides the secondary-transfer residual toners held on the peripheral surface of the intermediate transfer belt 11, with electric charges having a polarity reverse to that at the time of primary transfer. The secondary-transfer residual toners, having been provided with electric charges having a polarity reverse to that at the time of primary transfer, are electrostatically transferred to the peripheral surface of the electrophotographic photosensitive member 1 at the contact zone between the intermediate transfer belt 11 and the electrophotographic photosensitive member 1 and the vicinity thereof. Thus, the peripheral surface of the intermediate transfer belt 11 from which the synthesized toner image has been transferred is cleaned by the removal of the secondary-transfer residual toners. The secondary-transfer residual toners having been transferred to the peripheral surface of the electrophotographic photosensitive member 1 are removed by the cleaning means 7 together with the primary-transfer residual toners held on the peripheral surface of the electrophotographic photosensitive member 1. The transfer of the secondary-transfer residual toners from the intermediate transfer belt 11 to the electrophotographic photosensitive member 1 can be performed simultaneously with the primary transfer, and hence the throughput does not decrease.

The peripheral surface of the electrophotographic photosensitive member 1 from which the transfer residual toners have been removed by the cleaning means 7 may also be subjected to charge elimination by pre-exposure light emitted from a pre-exposure means. However, where as shown in FIG. 1, the charging means 3 is a contact charging means making use of a charging roller or the like, the pre-exposure is not necessarily required.

The electrophotographic photosensitive member 1 and the intermediate transfer belt 11 may be held in a container so as to be integrally joined and set up as a process cartridge, and this process cartridge may be so set up as to be detachably mountable to the main body of an electrophotographic apparatus, such as a copying machine or a laser beam printer. In the apparatus shown in FIG. 1, not only the electrophotographic photosensitive member 1 and the intermediate transfer belt 11, but also the charging means 3, the primary transfer means 6*p*, the cleaning means 7, and the charge-providing means 7*r*, are integrally supported to form a process cartridge, to provide a process cartridge 9 that is detachably mountable to the main body of the electrophotographic apparatus through a guide means (not shown) provided in the main body of the electrophotographic apparatus.

The process cartridge may also be integral at least at the time it is used by users. Taking account of the handling in the course of its manufacture and the readiness to disassemble them after recovery, the process cartridge may be so designed that it can be divided into some units, e.g., an electrophotographic photosensitive member unit having the electrophotographic photosensitive member and an intermediate transfer belt unit having the intermediate transfer belt.

In the foregoing, the present invention has been described giving as an example the case in which the electrophotographic endless belt of the present invention is used as the intermediate transfer belt. Besides the intermediate transfer belt, the electrophotographic endless belt of the present invention is also applicable to a belt member at large on which the prevention of meandering is required, such as electrophotographic photosensitive belts, transfer material transport belts, and fixing belts.

Physical properties in the present invention are measured in the following way.

Measurement of Thickness of Pressure-Sensitive Adhesive Layer:

The pressure-sensitive adhesive, double-coated tape is cut, and its cut surface is observed to measure the thickness of the pressure-sensitive adhesive layer.

Measurement of Hardness of Meandering-Preventive Member:

In the present invention, the hardness refers to JIS-A hardness, and is measured by the method prescribed in JIS K6253.

The present invention is described below in greater detail by giving specific working examples. However, the present invention is by no means limited to these. In the following Examples, "part(s)" means "part(s) by weight."

EXAMPLE 1

Sixty-nine point five parts of polyvinylidene fluoride resin, 8 parts of polyether ester amide, 0.2 part of perfluorobutane sulfonic acid and 20 parts of zinc oxide particles were kneaded at 210° C. by means of an extruder, and the kneaded product was extruded in a strand of 2 mm in diameter, which was then cut into pellets.

Using the pellets as a beltlike-substrate extrusion material, a beltlike substrate was formed by extrusion by means of the extrusion apparatus (blown-film extrusion apparatus) constructed as shown in FIG. 2.

In the extrusion apparatus constructed as shown in FIG. 2, a single-layer circular die of 100 mm in diameter was used as the circular die 103. The die slit was set to be 0.8 mm in width.

Then, the pellets, having been well dried by heating, were put into the material hopper 102 of this extrusion apparatus, and heated and melted. The molten product obtained was extruded at 210° C. from the circular die 103 to obtain a tubular film. The outside-cooling ring 105 was provided around the circular die 103, and air was blown from the circumference to the tubular film extruded, to effect cooling.

Air was also blown to the interior of the extruded tubular film through the gas inlet passage 104 to cause the film to inflate while scaling up until it came to have a diameter of 140 mm. Thereafter, the film was continuously drawn off at a constant speed by means of the draw-off unit. The proportion of the diameter of the circular die 103 to the diameter of the tubular film extruded came to 140%. Here, the air was stopped being fed at the time the diameter came to the desired value.

Further, subsequent to the draw-off through the pinch rollers 107, the tubular film was cut with the cutter 108. After the thickness of the tubular film became uniform, the film was cut in a width of 290 mm to form a tubular belt.

On this tubular film, its size and surface smoothness were regulated and folds were removed, using a set of cylindrical bodies consisting of an inner-form cylindrical body having a high coefficient of thermal expansion and an outer-form cylindrical body having a low coefficient of thermal expansion. More specifically, the tubular belt was placed over the inner-form cylindrical body, and these were inserted into the outer-form cylindrical body, having been worked to have a smooth inner surface, followed by heating for 20 minutes. Thereafter, these were cooled to room temperature, and the tubular belt was removed from the outer-form cylindrical body and inner-form cylindrical body. Thus, a beltlike substrate of 440 mm in peripheral length was obtained.

The beltlike substrate had a thickness of 80 μm, and had a volume resistivity of $2.2\times10^{10}$ Ω.cm.

Using as a meandering-preventive member a polyurethane foam with a thickness of 1.5 mm and a hardness of 40°, a pressure-sensitive adhesive, double-coated tape was stuck thereto. This pressure-sensitive adhesive, double-coated tape was one having a reinforcing base material which was a non-woven fabric base material having a thickness of 50 μm on one side of which an acrylic pressure-sensitive adhesive layer having a thickness of 55 μm was provided and on the other side of which an acrylic pressure-sensitive adhesive layer having a thickness 160 μm was also provided. This tape was stuck to the meandering-preventive member in such a way that the 160 μm thick acrylic pressure-sensitive adhesive layer was on the polyurethane foam (meandering-preventive member) side.

Then, this was cut in a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt 11 of 250 mm in width and 440 mm in peripheral length.

Figure 4:
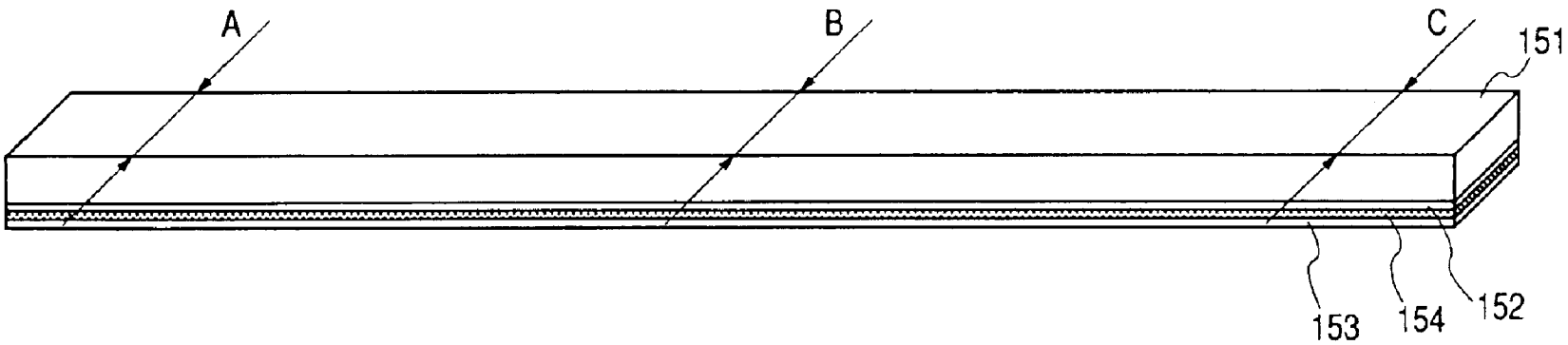
FIG. 4 is a schematic view for describing how to evaluate the working precision of the meandering-preventive member.

Evaluation of Working Precision of Meandering-Preventive Member:

To evaluate working precision, a meandering-preventive member 151 with a pressure-sensitive adhesive, double-coated tape (constituted of a reinforcing base material 154 and pressure-sensitive adhesive layers 152 and 153) having been stuck thereon, as shown in FIG. 4, was used, which had been worked by cutting in the shape of an oblong card. Its width was measured at three points in total, both end portions A and C (at places 30 mm inside from both ends) and middle portion B, and was evaluated by the difference between the maximum value and the minimum value of the measurements. This difference is regarded as the "working precision of the meandering-preventive member." It is preferable for the meandering-preventive member to have a working precision of 0.2 mm or less. If the meandering-preventive member has a working precision of more than 0.2 mm, it may have poor working precision as the meandering-preventive member, so that the one having been attached (stuck) to the beltlike substrate may not normally function as the meandering-preventive member.

Figure 5:
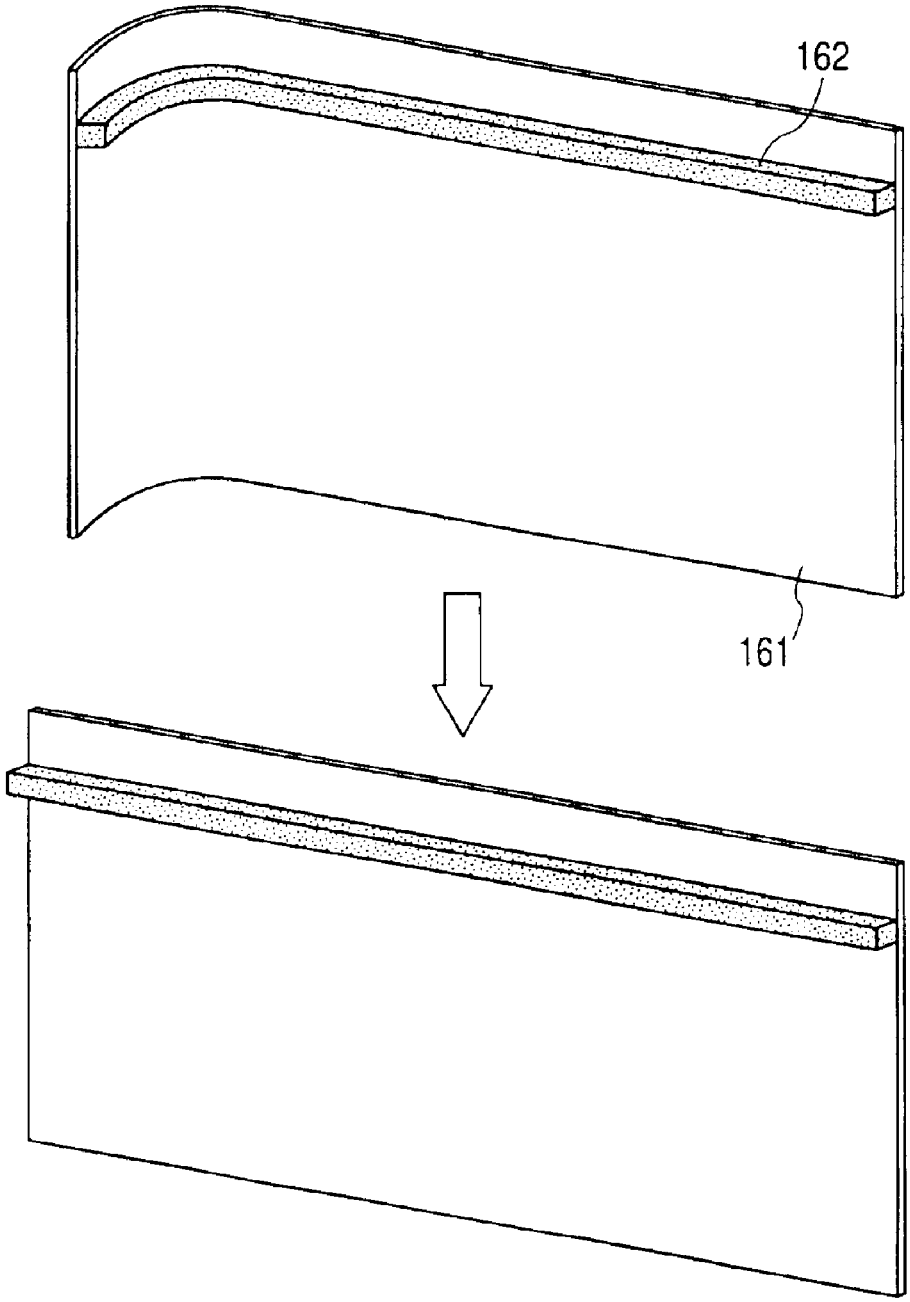
FIG. 5 is a schematic view for describing how to evaluate the sticking precision (straightness) of the meandering-preventive member.

Evaluation of Sticking Precision (Straightness) of Meandering-Preventive Member:

To evaluate the sticking precision of meandering-preventive member, as shown in FIG. 5 a beltlike substrate 161 with a meandering-preventive member 162 having been stuck thereto was cut through at the part where the meandering-preventive member was endlessly joined, and a measurement was carried out by using a three-dimensional measuring instrument at intervals of 10 mm in the peripheral direction.

Image Evaluation:

The intermediate transfer belt 11 produced was set in the electrophotographic apparatus constructed as shown in FIG. 1, and full-color images were formed on sheets of paper of 80 g/m$^2$ (basis weight) to conduct an image reproduction test. Any image misregistration or color misregistration was visually examined on images reproduced at the initial stage, to make an evaluation. The electrophotographic apparatus used was an apparatus employing a 600 dpi digital laser system. Subsequently, a continuous 5,000-sheet running test was also conducted at a process speed of 4 sheets per minute. After the running test, images were reproduced and evaluated in the same manner as those at the initial stage. As evaluation criteria, "A" is the best, and next thereto, "B" and "C" in this order.

Evaluation of Adherence of Meandering-Preventive Member:

Adherence of the meandering-preventive member before and after the above running test was evaluated (at the initial stage and after running). As evaluation criteria, "A" is the best, and next thereto, "B" and "C" in this order.

EXAMPLE 2

A beltlike substrate was produced in the same manner as the beltlike substrate of Example 1.

Using as a meandering-preventive member a polyurethane foam with a thickness of 1.5 mm and a hardness of 40°, a pressure-sensitive adhesive, double-coated tape was stuck thereto. This pressure-sensitive adhesive, double-coated tape was one having a reinforcing base material which was a non-woven fabric base material having a thickness of 50 μm on one side of which an acrylic pressure-sensitive adhesive layer having a thickness of 110 μm was provided and on the other side of which an acrylic pressure-sensitive adhesive layer having a thickness of 110 μm was also provided.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate. Both edges of this beltlike substrate were further cut to obtain an intermediate transfer belt of 250 mm in width and 440 mm in peripheral length.

The intermediate transfer belt was evaluated in the same manner as in Example 1.

EXAMPLE 3

A beltlike substrate was produced in the same manner as the beltlike substrate of Example 1.

Using as a meandering-preventive member a polyurethane foam with a thickness of 1.5 mm and a hardness of 40°, a pressure-sensitive adhesive, double-coated tape was stuck thereto. This pressure-sensitive adhesive, double-coated tape was one having a reinforcing base material which was a nonwoven fabric base material having a thickness of 50 μm on one side of which an acrylic pressure-sensitive adhesive layer having a thickness of 55 μm was provided and on the other side of which an acrylic pressure-sensitive adhesive layer having a thickness of 190 μm was also provided. This tape was stuck to the meandering-preventive member in such a way that the 190 μm thick acrylic pressure-sensitive adhesive layer was on the polyurethane foam (meandering-preventive member) side.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt of 250 mm in width and 440 mm in peripheral length.

The intermediate transfer belt was evaluated in the same manner as in Example 1.

EXAMPLE 4

A beltlike substrate was produced in the same manner as the beltlike substrate of Example 1.

Using as a meandering-preventive member a polyurethane foam with a thickness of 1.5 mm and a hardness of 20°, a pressure-sensitive adhesive, double-coated tape was stuck thereto. This pressure-sensitive adhesive, double-coated tape was one having a reinforcing base material which was a non-woven fabric base material having a thickness of 50 μm on one side of which an acrylic pressure-sensitive adhesive layer having a thickness of 55 μm was provided and on the other side of which an acrylic pressure-sensitive adhesive layer having a thickness of 160 μm was also provided. This tape was stuck to the meandering-preventive member in such a way that the 160 μm thick acrylic pressure-sensitive adhesive layer was on the polyurethane foam (meandering-preventive member) side.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt having a 250 mm width and a 440 mm peripheral length.

The intermediate transfer belt was evaluated in the same manner as in Example 1.

EXAMPLE 5

A beltlike substrate was produced in the same manner as the beltlike substrate of Example 1.

Using as a meandering-preventive member a polyurethane foam with a thickness of 1.5 mm and a hardness of 60°, a pressure-sensitive adhesive, double-coated tape was stuck thereto. This pressure-sensitive adhesive, double-coated tape was one having a reinforcing base material which was a non-woven fabric base material having a thickness of 50 μm on one side of which an acrylic pressure-sensitive adhesive layer having a thickness of 55 μm was provided and on the other side of which an acrylic pressure-sensitive adhesive layer having a thickness of 160 μm was also provided. This tape was stuck to the meandering-preventive member in such a way that the 160 μm thick acrylic pressure-sensitive adhesive layer was on the polyurethane foam (meandering-preventive member) side.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt having a 250 mm width and a 440 mm peripheral length.

The intermediate transfer belt was evaluated in the same manner as in Example 1.

COMPARATIVE EXAMPLE 1

A beltlike substrate was produced in the same manner as the beltlike substrate of Example 1.

Using as a meandering-preventive member a polyurethane foam with a thickness of 1.5 mm and a hardness of 60°, a pressure-sensitive adhesive, double-coated tape was stuck thereto. This pressure-sensitive adhesive, double-coated tape was one having a reinforcing base material which was a non-woven fabric base material having a thickness 50 μm on one side of which an acrylic pressure-sensitive adhesive layer having a thickness of 55 μm was provided and on the other side of which an acrylic pressure-sensitive adhesive layer having a thickness of 50 μm was also provided. This tape was stuck to the meandering-preventive member in such a way that the 50 μm thick acrylic pressure-sensitive adhesive layer was on the polyurethane foam (meandering-preventive member) side.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt having a 250 mm width and a 440 mm peripheral length.

The intermediate transfer belt was evaluated in the same manner as in Example 1.

After continuous 20-sheet image reproduction, image misregistration or color misregistration came to occur greatly, and also the meandering-preventive member came off partially from the beltlike substrate. Accordingly, the running test was stopped.

COMPARATIVE EXAMPLE 2

A beltlike substrate was produced in the same manner as the beltlike substrate of Example 1.

Using as a meandering-preventive member a polyurethane foam with a thickness of 1.5 mm and a hardness of 60°, a pressure-sensitive adhesive, double-coated tape was stuck thereto. This pressure-sensitive adhesive, double-coated tape was one having a reinforcing base material which was a non-woven fabric base material having a thickness of 50 μm on one side of which an acrylic pressure-sensitive adhesive layer having a thickness of 55 μm was provided and on the other side of which an acrylic pressure-sensitive adhesive layer having a thickness of 100 μm was also provided. This tape was stuck to the meandering-preventive member in such a way that the 100 μm thick acrylic pressure-sensitive adhesive layer was on the polyurethane foam (meandering-preventive member) side.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt having a 250 mm width and a 440 mm peripheral length.

The intermediate transfer belt was evaluated in the same manner as in Example 1.

COMPARATIVE EXAMPLE 3

A beltlike substrate was produced in the same manner as the beltlike substrate 1 of Example 1.

Using as a meandering-preventive member a polyurethane foam with a thickness of 1.5 mm and a hardness of 60°, a pressure-sensitive adhesive, double-coated tape was stuck thereto. This pressure-sensitive adhesive, double-coated tape was one having a reinforcing base material which was a non-woven fabric base material having a thickness of 50 μm on one side of which an acrylic pressure-sensitive adhesive layer having a thickness of 55 μm was provided and on the other side of which an acrylic pressure-sensitive adhesive layer having a thickness of 300 μm was also provided. This tape was stuck to the meandering-preventive member in such a way that the 300 μm thick acrylic pressure-sensitive adhesive layer was on the polyurethane foam (meandering-preventive member) side.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt having a 250 mm width and a 440 mm peripheral length.

The intermediate transfer belt was evaluated in the same manner as in Example 1.

The meandering-preventive member was unable to act against a twist force, and image misregistration or color misregistration occurred greatly from the beginning. Accordingly, the running test was stopped.

COMPARATIVE EXAMPLE 4

A beltlike substrate was produced in the same manner as the beltlike substrate of Example 1.

Using as a meandering-preventive member a polyurethane foam with a thickness of 1.5 mm and a hardness of 60°, a pressure-sensitive adhesive, double-coated tape was stuck thereto. This pressure-sensitive adhesive, double-coated tape was one having a reinforcing base material which was a non-woven fabric base material having a thickness of 50 μm on one side of which an acrylic pressure-sensitive adhesive layer having a thickness of 55 μm was provided and on the other side of which an acrylic pressure-sensitive adhesive layer having a thickness of 210 μm was also provided. This tape was stuck to the meandering-preventive member in such a way that the 210 μm thick acrylic pressure-sensitive adhesive layer was on the polyurethane foam (meandering-preventive member) side.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt having a 250 mm width and a 440 mm peripheral length.

The intermediate transfer belt was evaluated in the same manner as in Example 1.

COMPARATIVE EXAMPLE 5

A beltlike substrate was produced in the same manner as the beltlike substrate of Example 1.

Using as a meandering-preventive member a polyurethane foam with a thickness of 1.5 mm and a hardness of 10°, a pressure-sensitive adhesive, double-coated tape was stuck thereto. This pressure-sensitive adhesive, double-coated tape was one having a reinforcing base material which was a non-woven fabric base material having a thickness of 50 μm on one side of which an acrylic pressure-sensitive adhesive layer having a thickness of 55 μm was provided and on the other side of which an acrylic pressure-sensitive adhesive layer having a thickness of 160 μm was also provided. This tape was stuck to the meandering-preventive member in such a way that the 160 μm thick acrylic pressure-sensitive adhesive layer was on the polyurethane foam (meandering-preventive member) side.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt having a f 250 mm width and a 440 mm peripheral length.

The meandering-preventive member was not good in both the working precision and the sticking precision (straightness). For confirmation, however, the intermediate transfer belt was evaluated in the same manner as in Example 1.

Image misregistration or color misregistration occurred greatly from the beginning. Accordingly, the running test was stopped.

COMPARATIVE EXAMPLE 6

A beltlike substrate was produced in the same manner as the beltlike substrate of Example 1.

Using as a meandering-preventive member a polyurethane foam with a thickness of 1.5 mm and a hardness of 90°, a pressure-sensitive adhesive, double-coated tape was stuck thereto. This pressure-sensitive adhesive, double-coated tape was one having a reinforcing base material which was a non-woven fabric base material having a thickness of 50 μm on one side of which an acrylic pressure-sensitive adhesive layer having a thickness of 55 μm was provided and on the other side of which an acrylic pressure-sensitive adhesive layer of 160 μm in thickness was also provided. This tape was stuck to the meandering-preventive member in such a way that the 160 μm thick acrylic pressure-sensitive adhesive layer was on the polyurethane foam (meandering-preventive member) side.

Then, this was cut to a width of 5 mm and a length of 436 mm to make a meandering-preventive member with pressure-sensitive adhesive, double-coated tape.

The meandering-preventive member with pressure-sensitive adhesive, double-coated tape was stuck to the beltlike substrate (the 55 μm thick acrylic pressure-sensitive adhesive layer was on the beltlike substrate side). Both edges of this beltlike substrate were further cut to obtain an intermediate transfer belt having a 250 mm width and a 440 mm peripheral length.

The intermediate transfer belt was evaluated in the same manner as in Example 1.

The meandering-preventive member had so high a hardness as to lack in flexing properties, so that no stable belt travel was performable, and image misregistration or color misregistration occurred greatly from the beginning. Accordingly, the running test was stopped.

The results of evaluation in Examples 1 to 5 and Comparative Examples 1 to 6 are shown in Table 1.

TABLE 1

| | | Thickness of Adhesive Layer of Double-Coated Tape | | Hardness | Working Precision | Sticking Precision | Image | | | |
|---|---|---|---|---|---|---|---|---|---|---|
| | | Meandering Preventive Member Side (μm) | Beltlike Substrate Side (μm) | of Meandering Preventive Member (°) | of Meandering Preventive Member (mm) | of Meandering Preventive Member (mm) | Misregistration of Color Misregistration Initial Stage | Misregistration of Color Misregistration After Running | Adherence Initial Stage | Adherence After Running |
| Example | 1 | 160 | 55 | 40 | 0.05 | 0.08 | A | A | A | A |
| | 2 | 110 | 110 | 40 | 0.05 | 0.10 | A | A | B | B |
| | 3 | 190 | 55 | 40 | 0.10 | 0.12 | B | B | A | A |
| | 4 | 160 | 55 | 20 | 0.18 | 0.22 | B | B | A | A |
| | 5 | 160 | 55 | 60 | 0.05 | 0.08 | B | B | A | A |
| Comparative Example | 1 | 50 | 55 | 40 | 0.05 | 0.08 | B | C | C | — |
| | 2 | 100 | 55 | 40 | 0.05 | 0.08 | A | C | B | C |
| | 3 | 300 | 55 | 40 | 0.16 | 0.25 | C | C | A | — |
| | 4 | 210 | 55 | 40 | 0.12 | 0.23 | B | C | A | B |
| | 5 | 160 | 55 | 10 | 0.25 | 0.40 | C | C | A | — |
| | 6 | 160 | 55 | 90 | 0.05 | 0.08 | C | C | A | — |

As shown in Table 1, the present invention enables smooth belt travel, and makes it possible to obtain an electrophotographic endless belt almost free from meandering over a long period of time, and a process cartridge and an electrophotographic apparatus which have this electrophotographic endless belt.

What is claimed is:

1. An electrophotographic endless belt comprising:

a beltlike substrate; and a meandering-preventive member attached to the inner peripheral surface of said beltlike substrate via a pressure-sensitive adhesive, double-coated tape, said pressure-sensitive adhesive, double-coated tape comprising:

i) a reinforcing base material; and ii) pressure-sensitive adhesive layers on both sides of said reinforcing base material, wherein said reinforcing base material has a thickness of from 25 μm or more to 200 μm or less, wherein said pressure-sensitive adhesive layers on both sides each have a thickness of 200 μm or less and at least one of said pressure-sensitive adhesive layers has a thickness of from more than 100 μm to 200 μm or less, and wherein said meandering-preventive member has a hardness of from 15° or more to 70° or less.

2. The electrophotographic endless belt according to claim 1, wherein at least one of said pressure-sensitive adhesive layers has a thickness of from 110 μm or more to 190 μm or less.

3. The electrophotographic endless belt according to claim 1, wherein said meandering-preventive member has a hardness of from 20° or more to 60° or less.

4. The electrophotographic endless belt according to claim 1, wherein said meandering-preventive member has a working precision of 0.2 mm or less.

5. The electrophotographic endless belt according to claim 1, wherein said electrophotographic endless belt is an intermediate transfer belt.

6. A process cartridge detachably mountable to the main body of an electrophotographic apparatus, said process cartridge comprising:

an electrophotographic endless belt comprising:

a beltlike substrate; and a meandering-preventive member attached to the inner peripheral surface of said beltlike substrate via a pressure-sensitive adhesive, double-coated tape comprising:

i) a reinforcing base material; and ii) pressure-sensitive adhesive layers on both sides of said reinforcing base material, wherein said reinforcing base material has a thickness of from 25 μm or more to 200 μm or less, wherein said pressure-sensitive adhesive layers on both sides each have a thickness of 200 μm or less and at least one of said pressure-sensitive adhesive layers has a thickness of from more than 100 μm to 200 μm or less, and wherein said meandering-preventive member has a hardness of from 15° or more to 70° or less.

7. The process cartridge according to claim 6, wherein said electrophotographic endless belt is an intermediate transfer belt.

8. The process cartridge according to claim 7, further comprising an electrophotographic photosensitive member.

9. An electrophotographic apparatus comprising:

an electrophotographic photosensitive member;

a charging device configured and positioned to charge said electrophotographic photosensitive member electrostatically;

an exposure device configured and positioned to form an electrostatic latent image on said electrophotographic photosensitive member having been charged by said charging device;

a developing device configured and positioned to develop the electrostatic latent image formed on said electrophotographic photosensitive member by said exposure device, to form a toner image on said electrophotographic photosensitive member;

an intermediate transfer belt which is positioned and configured to form a contact zone between itself and said electrophotographic photosensitive member, to secondarily transfer to a transfer material the toner image transferred after the toner image has been primarily transferred thereto from said electrophotographic photosensitive member; and a primary transfer device configured and positioned to transfer the toner image primarily from said electrophotographic photosensitive member to said intermediate transfer belt at the contact zone therebetween, said intermediate transfer belt comprising:

a beltlike substrate; and a meandering-preventive member attached to the inner peripheral surface of said beltlike substrate via a pressure-sensitive adhesive, double-coated tape comprising:

i) a reinforcing base material; and ii) pressure-sensitive adhesive layers on both sides of said reinforcing base material, wherein said reinforcing base material has a thickness of from 25 $\mu$m or more to 200 $\mu$m or less, wherein said pressure-sensitive adhesive layers on both sides each have a thickness of 200 $\mu$m or less and at least one of said pressure-sensitive adhesive layers has a thickness of from more than 100 $\mu$m to 200 $\mu$m or less, and wherein said meandering-preventive member has a hardness of from 15° or more to 70° or less.

10. The electrophotographic apparatus according to claim 9, further comprising a process cartridge integrally supporting at least said electrophotographic photosensitive member and said intermediate transfer belt and being detachably mountable to the main body of the electrophotographic apparatus.

* * * * *